US005411001A

United States Patent [19]

Werner et al.

[11] Patent Number: 5,411,001

[45] Date of Patent: May 2, 1995

[54] FUEL LINE ARRANGEMENT IN THE CYLINDER HOUSING OF AN INTERNAL COMBUSTION ENGINE AND METHOD OF MAKING THE FUEL PASSAGES

[75] Inventors: Johannes Werner, Waiblingen; Ernst-Wilhelm Hufendick, Stuttgart; Walter Kerschbaum, Fellbach, all of Germany

[73] Assignee: Mercedes-Benz A.G., Stuttgart, Germany

[21] Appl. No.: 285,502

[22] Filed: Aug. 3, 1994

[30] Foreign Application Priority Data

Aug. 4, 1993 [DE] Germany ..... 43 26 162.0

[51] Int. Cl.[6] ..... F02M 55/02; F02M 39/02

[52] U.S. Cl. ..... 123/456; 123/468; 123/195 R; 29/888.01

[58] Field of Search ..... 123/456, 514, 195 R, 123/468–469; 29/888.01

[56] References Cited

U.S. PATENT DOCUMENTS 5,022,371 6/1991 Daly et al. ..... 123/468
5,163,406 11/1992 Daly et al. ..... 123/456
5,297,524 3/1994 Fransson et al. ..... 123/468
5,299,540 4/1994 Fransson et al. ..... 123/468

FOREIGN PATENT DOCUMENTS 2184792 7/1987 United Kingdom .
2195708 4/1988 United Kingdom .
9301409 1/1993 WIPO .

*Primary Examiner*—Henry C. Yuen
*Assistant Examiner*—Thomas N. Moulis
*Attorney, Agent, or Firm*—Klaus J. Bach

[57] ABSTRACT

In a fuel line arrangement in the cylinder housing of an internal combustion engine with cylinders arranged in line and upstanding mounting structures with support bores for the reception of plug-in fuel injection pumps formed on the sides of the cylinders a fuel return passage extends through the cylinder housing so as to intersect all the fuel pump support bores, a fuel supply passage extends through the cylinder housing parallel to the fuel return passage and oblique passages extend between the fuel supply passages and the respective fuel pump support bores for supplying fuel to the plug-in pumps within the fuel pump support bores, the oblique passages being arranged such that their outward extensions are within the confines of the fuel pump support bore top opening to facilitate drilling of the oblique bores.

13 Claims, 4 Drawing Sheets

FUEL LINE ARRANGEMENT IN THE CYLINDER HOUSING OF AN INTERNAL COMBUSTION ENGINE AND METHOD OF MAKING THE FUEL PASSAGES

BACKGROUND OF THE INVENTION

The invention relates to a fuel line structure in the cylinder housing of an internal combustion engine having individual injection pumps For each cylinder mounted in mounting openings in the cylinder housing which also includes fuel supply and return passages which extend through the cylinder housing and are in communication with the various fuel pumps For supplying fuel thereto and For receiving excess fuel therefrom and also to a method of Forming such passages into the cylinder housing.

In the printed publication of KHD DEUTZ, "DEUTZ automotive", in which the new DEUTZ engine series For commercial vehicles starting with 1992 are described, there is shown a cross-sectional view of one of the individual unit injection pumps which are designed as plug-in pumps with fuel Flow passages disposed in the cylinder housing of a multicylinder internal combustion engine which has a main fuel channel intersecting the mounting bores receiving the plug-in injection pumps.

It is the principal object of the present invention to provide in the cylinder housing of an internal combustion engine, by simple measures, a space-efficient and relatively lightweight fuel supply means and to provide a simple and efficient method of preparing such fuel supply means.

SUMMARY OF THE INVENTION

In a fuel line arrangement in the cylinder housing of an internal combustion engine with cylinders arranged in line and upstanding mounting structures with support bores for the reception of plug-in fuel injection pumps formed on the sides of the cylinders a fuel return passage extends through the cylinder housing so as to intersect all the fuel pump support bores, a fuel supply passage extends through the cylinder housing parallel to the fuel return passage and oblique passages extend between the fuel supply passages and the respective fuel pump support bores for supplying fuel to the plug-in pumps within the fuel pump support bores, the oblique passages being arranged such that their outward extensions are within the confines of the fuel pump support bore top opening to facilitate drilling of the oblique bores.

Because of the special arrangement of the longitudinal passages there is no need for additional space-consuming solid rib structures or increased casting wall thicknesses and because of the special fuel line connection between the mounting bore and,the longitudinal fuel supply passage there is no need for the ball plugs generally used in the transverse bores extending through the mounting bores. Furthermore, since the longitudinal fuel supply passage extends spaced from the plug-in pumps and fuel is supplied to the plug-in pumps from the longitudinal passage via oblique passages, there is no increase in the temperature of the fuel.

Since the connecting web only includes the longitudinal fuel return passage the web may be narrow so that does not contribute much weight. The return fuel passage extending through the centers of the fuel pump mounting bores permits the use of diagonally opposite clamping screws for fastening the plug-in pump on the mounting bore pump support face, which arrangement also provides for symmetrical fastening of the pump.

It is particularly advantageous if the longitudinal fuel supply passage is located within an area of the housing walls with increased wall thickness such as the jointure area of the walls of neighboring chambers where a thickened wall structure is formed. In those areas also the oblique connecting bores can be drilled easily.

In further embodiments of the invention, for example, in a cylinder housing with two cylinder banks, the oblique passages of the one cylinder bank and the mounting bores on the support surfaces for the pumps of the other cylinder bank cam be drilled at one time and with one operating head, and also the mounting bore threads can be cut in the same operating step since the different machining steps for the different cylinder banks have nevertheless the same working direction.

In accordance with the method according to the invention the longitudinal fuel supply passage is first drilled and only then are the oblique connecting passages drilled in order to avoid that the coolant required for longbore drilling is discharged through the oblique passages.

In a further step the main fuel return passage is drilled which intersects the pump mounting bore areas which however, at that point comprise still solid material. Then the mounting bores are drilled which have a relatively large diameter for the reception of the plug-in pumps.

In an embodiment of the invention wherein in the upper part of the area in which the pump mounting bores are to be drilled there are trough-like depressions formed into the solid material with inclined side wall portions which provide for a drill base for drilling the oblique passages so that the oblique passages can be drilled without any special preparation before the mounting bores for the pumps are drilled.

The lowest parts of the trough-like depressions assist in drilling the pump mounting bores as they will center the drilling tool. If the raw casting block is provided with cavities at the side opposite the trough-like depressions only a relatively small amount of the casting material needs to be removed during drilling of the pump mounting bores.

DESCRIPTION OF A PREFERRED EMBODIMENT

Figure 1:
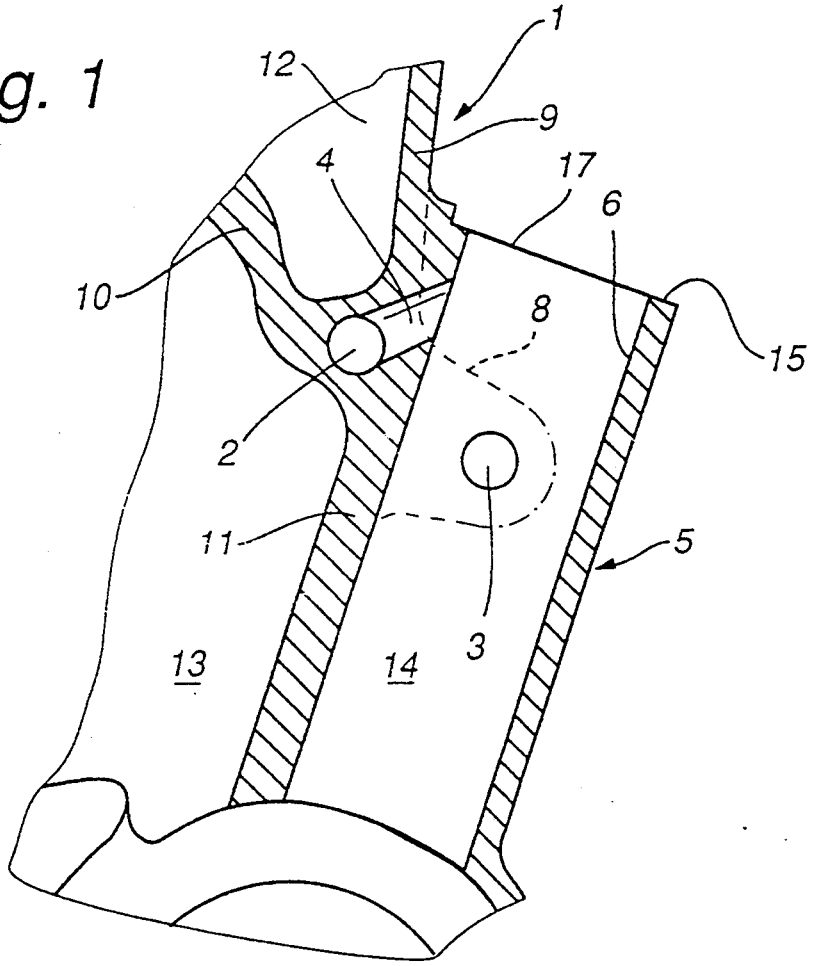
FIG. 1 shows an arrangement of the fuel supply and discharge passages for the plug-in fuel pumps in the cylinder block of a multicylinder engine.

A cylinder housing 1 according to FIG. 1 for use in an internal combustion engine having cylinders arranged in a row includes fuel passages comprising essentially a longitudinal fuel supply passage 2 and a fuel return passage 3 extending parallel to the longitudinal fuel supply passage 2, and oblique bores 4 providing For communication with the longitudinal fuel supply passage 2, Along the side of the row of cylinders, upstanding mounting structures 5 are cast integrally with the cylinder housing which have support bores 6 for receiving the plug-in pumps 7 (FIG. 2), Between the respective mounting structures 5 there are provided reinforcement web structures 8 which project From the side surfaces of the cylinder housing and which are relatively narrow but sufficient 1 y wide to include the fuel return passages 3 which extend through the axes of the pump mounting structures 5.

The longitudinal fuel supply passage 2 extends through an area in which the walls 9, 10, 11 of adjacent chambers 12, 13, 14 join together and form a relatively thick-walled area. It is disposed at about the same level as the fuel return passage 3 and extends parallel thereto but spaced from the plug-in pumps 7.

The mounting structures 5 have pump support surfaces 15 and the oblique bores 4 extend from the longitudinal fuel supply passage 2 to an area of the pump support bore 6 below the support surface 15. The outward extensions of these oblique bores are disposed within the upper openings 17 of the support bores 6.

Figure 2:
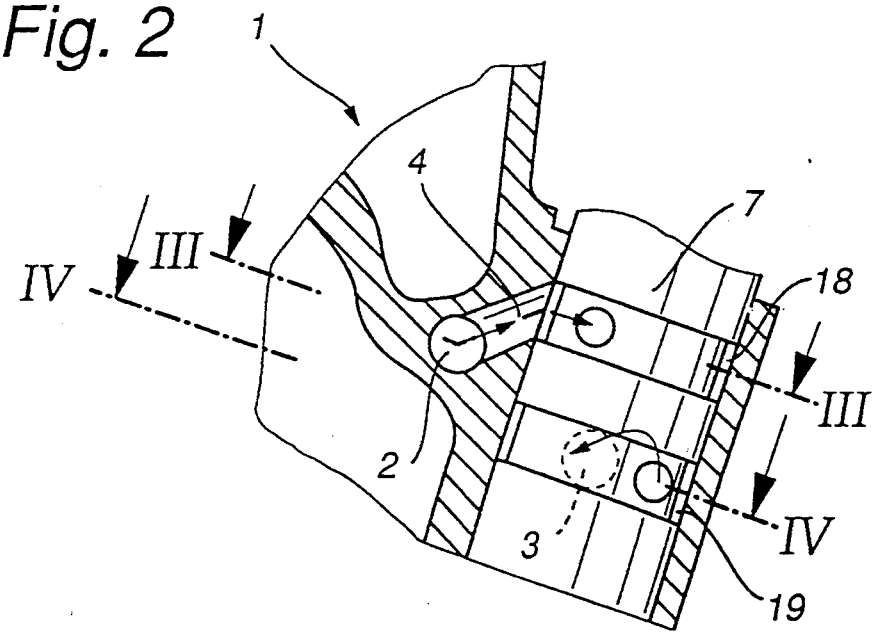
FIG. 2 shows the plug-in fuel pump disposed in the pump mounting bore wherein the flow of fuel is indicated by arrows.

FIG. 2 shows the arrangement with a plug-in pump 7 inserted into the pump support bore 6. Arrows indicate the flow path of the fuel. The plug-in pump 7 is provided with annular grooves 18, 19 of which the upper annular fuel conducting groove 18 is in communication with the oblique bore 4 whereas the lower annular fuel conducting groove 19 is in communication with the fuel return passage 3.

Figure 3:
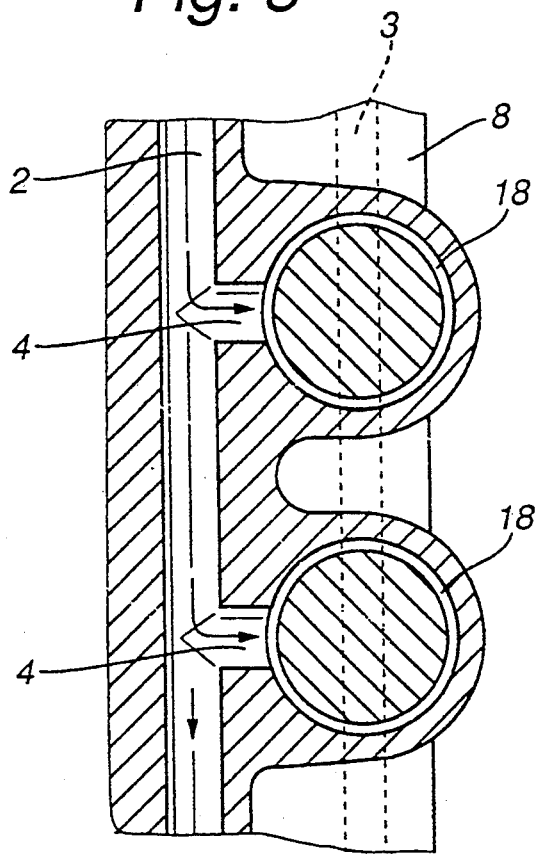
FIG. 3 is a cross-sectional view along line III-III of FIG. 2.
Figure 4:
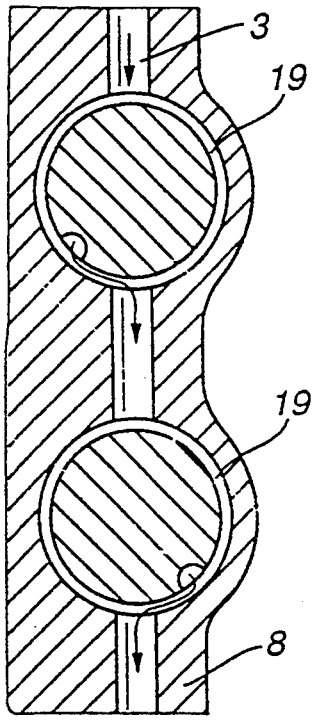
FIG. 4 is a cross-sectional view along line IV-IV of Fig, 2.

FIG. 3 shows the fuel passages for supplying fuel to the plug-in pumps 7 and FIG. 4 shows the arrangement of the fuel return passages. In both FIGS. 3 and 4 the interconnecting web structures 8 which receive the return fuel passage 3 are shown in top view.

Figure 5:
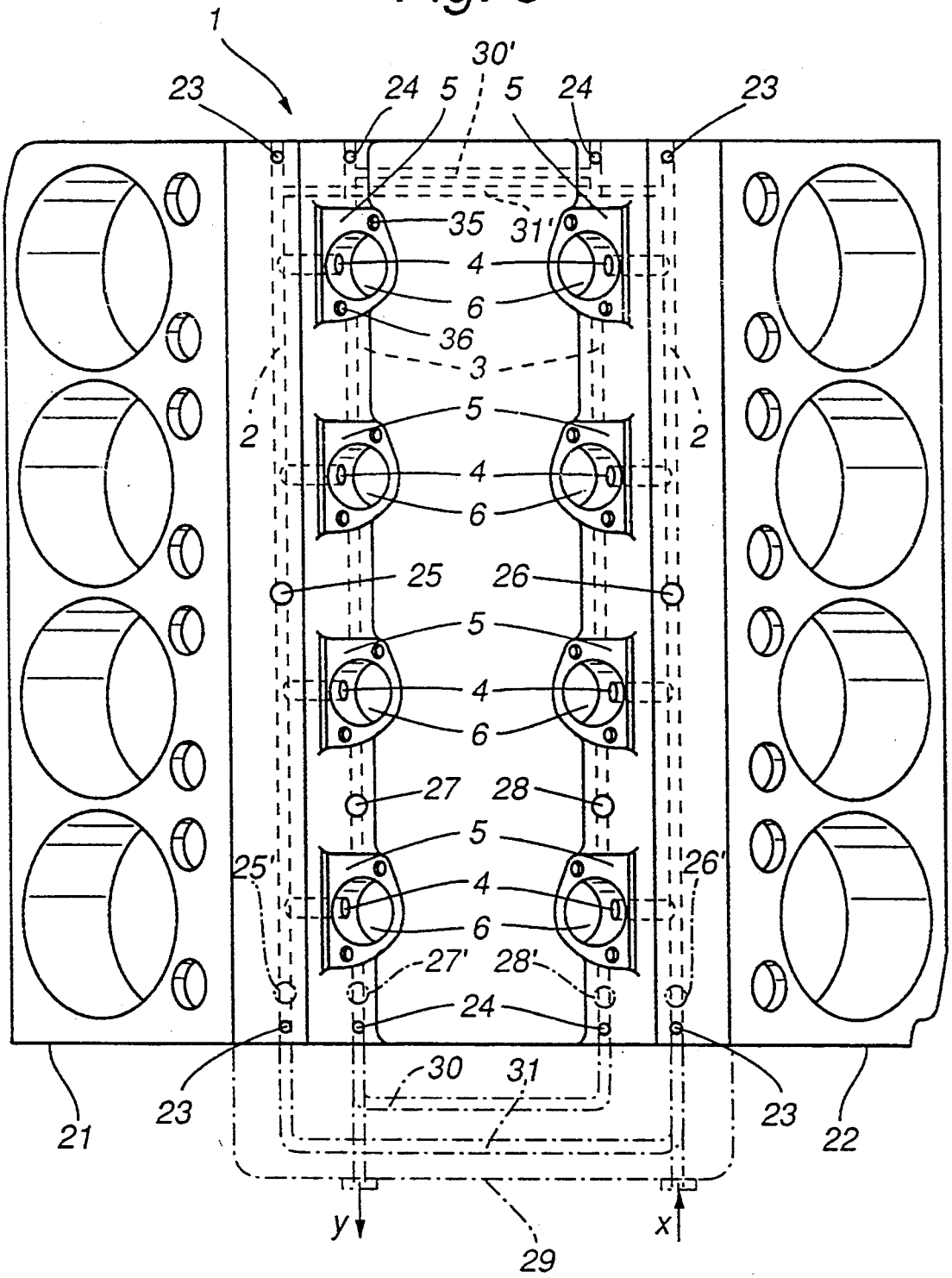
FIG. 5 is a top view of a cylinder housing with cylinder banks arranged in the shape of a V wherein the fuel passages are indicated.

The fuel flow passages are arranged in the same manner as described above in a cylinder housing with cylinder banks 21, 22 arranged in the shape of a V (FIG. 5).

The longitudinal fuel supply passages 2 and the fuel return passages 3 are, at their ends, sealed by ball plugs 23, 24. In the middle of the longitudinal fuel supply passage 2 there are connections 25, 26 for a fuel supply line (not shown) and there are connections 27, 28 for a fuel return line (not shown). The return line connections are disposed between two upstanding pump mounting structures 5, but they may also be disposed at the end of the cylinder banks adjacent the outermost mounting structure 5 and they are indicated in this position in FIG. 5 in dash-dotted lines and designated by numerals 27', 28'. The same applies to the connections for the supply lines which are indicated in this position by reference numerals 25', 26'. As indicated in FIG. 5 by dash-dotted lines, the fuel passages may be open at one end of the cylinder banks and interconnected by transverse passages 31 formed in a cover 29 mounted on the face ends of the cylinder housing 2 as shown by dash-dotted lines: The passage arrangement in at least one cover can be such that the connections for the fuel supply and return lines are provided on the cover 29 as indicated by arrows x and y. Instead of the cover 29 with passages therein, there may be provided interconnecting tubes (which are not shown).

Figure 6:
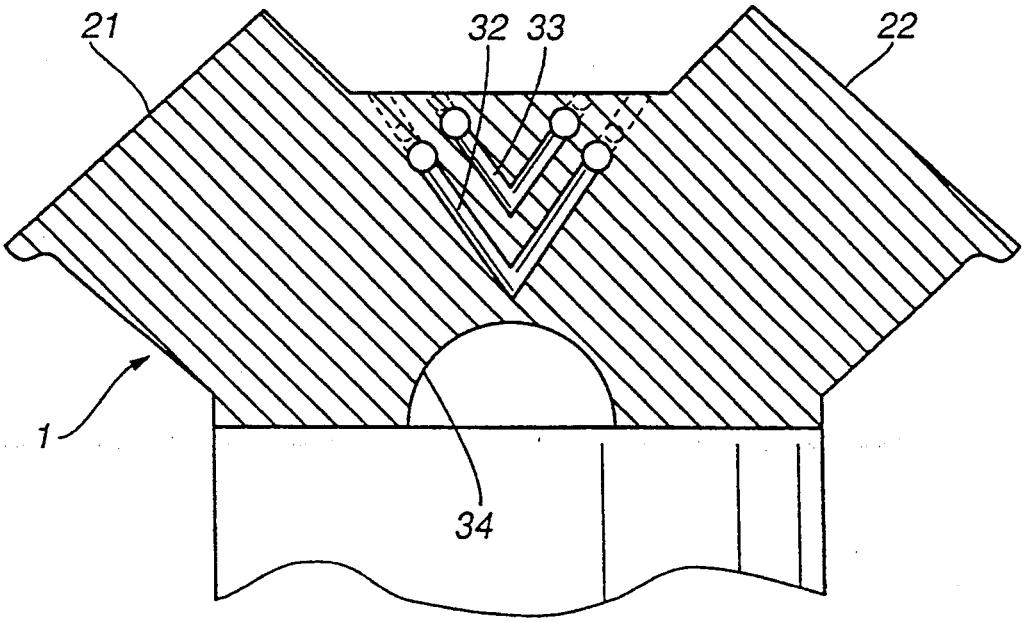
FIG. 6 shows another arrangement for the fuel flow passages.

The fuel passages of both cylinder banks may also be interconnected by straight transverse bores 30', 31'which extend within the cylinder housing or by V-shaped bores 32, drilled into the cylinder housing so that they join adjacent a camshaft bearing support wall as shown schematically in Fig. 6.

The transverse bores 30', 31'or the V-shaped bores 32, 33 may al so be arranged between two cylinders of each cylinder bank (not shown).

Each pump support surface is provided with mounting bores 35, 36 which, with respect tQ the axis of the support bore 6, are arranged diametrically opposite one another but angularly displaced from the fuel return passage 3 so as to avoid interference with the return fuel passage upon drilling of the mounting bores.

Figure 7:
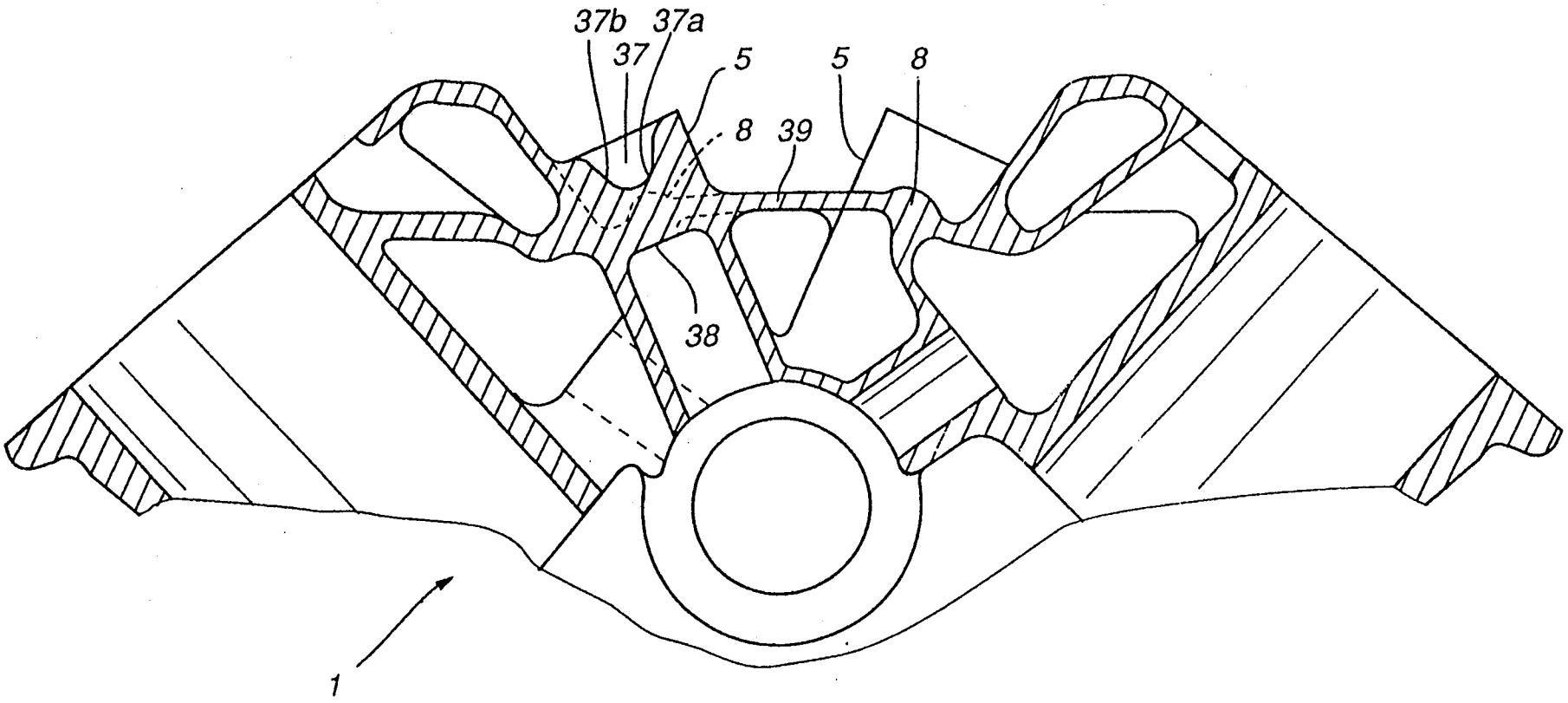
FIG. 7 shows a portion of the cylinder housing as raw casting.

FIG. 7 is a cross-sectional view of a raw casting of a cylinder housing 1 for an internal combustion engine with two cylinder banks arranged in the shape of a V, wherein the elongated upstanding mounting structures 5 which project partially into the V space between the cylinder banks are shown to be partially solid. The upper contour, that is, the recess 37 of each mounting structure 5, is trough-like recessed and has a low point 37*a* coinciding with the longitudinal axis the mounting structure 5. The underside of the mounting structure has a cavity 38 formed therein which extends upwardly only far enough to leave a web-like solid cast wall portion between the recess 37 and the cavity 38.

Furthermore, the raw contour casting is provided at its longitudinal sides with narrow reinforcement web structures 8 which extend between adjacent mounting structures 5. In a single bank cylinder housing the web structures 8 extending between the mounting structures 5 extend only alongside the cylinder housing 1 (FIG. 1). In two-bank cylinder housings the web structures 8 may extend outwardly to join the wall structure 39 of a coolant channel extending longitudinally between the cylinder banks.

In order to form the fuel passages into the raw contour casting in a first step the fuel return passage 3 which extends through the web structures 8 and through all the mounting structures 5 may be drilled from both face ends of the cylinder housing 1. The fuel return passage 3 intersects the longitudinal axis of each mounting structure 5. The longitudinal passage 2 can be drilled in the same manner, advantageously concurrently with the fuel return passage 3. Subsequently the oblique bore 4 can be drilled starting from the wall area 37*b* of the recess 37 of each mounting structure 5 which, because of the inclination of the wall area 37*b*, provides for a good starting base for drilling the bore 4 which intersects the longitudinal passage 2 for communication therewith. Finally, the support bore 6 for the reception of the plug-in pump 7 is drilled utilizing the lowest point 37*a* of the recess 37 which coincides with the axis of the mounting structure 5 as a drill centering structure. During drilling only relatively little material is removed since only a relatively narrow web structure represents the solid portion of the elongated mounting structure 5.

What is claimed is:

1. A fuel line arrangement in the cylinder housing of an internal combustion engine with cylinders arranged in line and upstanding mounting structures with support bores for the reception of plug-in fuel injection pumps formed on the sides of said cylinders, said cylinder housing including fuel supply and fuel return lines in communication with said plug-in fuel injection pumps in said support bores, comprising: a fuel return passage extending through the cylinder housing and intersecting the support bores for the reception of said fuel pumps, a longitudinal fuel supply passage extending alongside said cylinders through the cylinder housing parallel to, and essentially at the same level as, said fuel return passage, an oblique bore extending between each pump support bore and said longitudinal fuel supply passage for supplying fuel to the fuel pumps in said fuel support bores, said oblique bores being arranged in such a manner that their outward extensions are within the confines of said fuel pump support bores to facilitate drilling of said oblique bores.

2. A fuel line arrangement according to claim 1, wherein said mounting structures for said plug-in pumps project from the longitudinal sides of said cylinder housing and are interconnected by reinforcement webs projecting from the longitudinal side of the cylinder housing and said fuel return passage extends through said reinforcement webs and intersects said mounting structures essentially in the center of their support bores.

3. A fuel line arrangement according to claim 1, wherein said fuel supply passage extends through the cylinder housing in an area where walls of adjacent chambers are joined and therefore provide a wall area of relatively large thickness.

4. A fuel line arrangement according to claim 1, wherein each of said mounting structures has a fuel pump support surface and said oblique bores which extend between said fuel supply passage and said fuel pump support bores open into said pump support bores near said fuel pump support surfaces.

5. A fuel line arrangement according to claim 1, wherein said longitudinal fuel supply passage and said fuel return passage extend over the full length of the cylinder housing and are sealed at opposite ends by ball plugs,

6. A fuel line arrangement according to claim 1, wherein said internal combustion engine has two cylinder banks arranged in the shape of a V, and the oblique bores of one of the cylinder banks extend in axially parallel relationship with the support bores of the other cylinder bank.

7. A fuel line arrangement according to claim 6, wherein the respective longitudinally extending fuel supply and fuel return passages are interconnected by transverse passages formed in a cover disposed on at least one end face of the cylinder housing.

8. A fuel line arrangement according to claim 6, wherein the respective longitudinal fuel supply and fuel return passages of both cylinder banks are interconnected by transverse passages formed in a camshaft bearing support wall of said cylinder housing.

9. A fuel line arrangement according to claim 7, wherein said transverse passages are bores arranged in the shape of a V and drilled into the cylinder housing so as to join in the bearing support wall.

10. A method of drilling a fuel line arrangement into the raw casting of the cylinder housing of an internal combustion engine with cylinders arranged in line and with upstanding mounting structures for the support of plug-in fuel injection pumps formed on the sides of the cylinders, wherein said fuel pump support structures include a solid material section, said method comprising the steps of: drilling a fuel return passage through said cylinder housing so as to extend through the sol id material section in said fuel pump support structures and also drilling a fuel supply passage through said cylinder housing in parallel relationship with said fuel return passage, drilling an oblique bore through said fuel pump support structure from the top side thereof into said fuel supply passage for communication therewith, and drilling a fuel pump support bore into each of said fuel pump support structures.

11. A method according to claim 10, wherein said fuel supply and return passages are drilled at the same time and from opposite ends of said cylinder housing.

12. A method according to claim 10, wherein said fuel pump mounting structures on said raw casting have trough-like recesses formed at their tops with lowest points disposed in the axial centers of said mounting structures and said recesses have inclined side walls disposed at such an angle that they extend essentially normal to the drilling direction for the oblique bores so as to provide starting bases for drilling said oblique bores.

13. A method according to claim 12, wherein said raw casting has a cavity formed into the lower side of said fuel pump mounting structures and extending to a point spaced from the lowest point of said trough-like recess such that a web structure of solid material remains therebetween through which the fuel return passage extending through said cylinder housing is drilled and said web structure is removed upon drilling of said fuel pump support bore.

* * * * *